US011312549B2

(12) United States Patent
Dai

(10) Patent No.: US 11,312,549 B2
(45) Date of Patent: Apr. 26, 2022

(54) BOTTLE CAP WITH NON-BREAK PLATES

(71) Applicant: TAIWAN HON CHUAN ENTERPRISE CO., LTD., Taichung (TW)

(72) Inventor: Keith H Dai, Taichung (TW)

(73) Assignee: TAIWAN HON CHUAN ENTERPRISE CO., LTD., Taichung (TW)

( * ) Notice: Subject to any disclaimer, the term of this patent is extended or adjusted under 35 U.S.C. 154(b) by 520 days.

(21) Appl. No.: 16/446,608

(22) Filed: Jun. 19, 2019

(65) Prior Publication Data

US 2020/0399036 A1 Dec. 24, 2020

(51) Int. Cl.
*B65D 55/16* (2006.01)
*B65D 41/34* (2006.01)

(52) U.S. Cl.
CPC ..... *B65D 55/16* (2013.01); *B65D 41/3428* (2013.01)

(58) Field of Classification Search
CPC ..... B65D 55/16; B65D 41/325; B65D 41/34; B65D 41/3423; B65D 41/3428; B65D 41/3404; B65D 41/3409; B65D 41/3414; B65D 41/3419; B65D 41/3433; B65D 41/3438; B65D 2401/30; B65D 2401/35; B65D 2401/40
See application file for complete search history.

(56) References Cited

FOREIGN PATENT DOCUMENTS

WO 2010004919 A1 1/2010

*Primary Examiner* — Don M Anderson
(74) *Attorney, Agent, or Firm* — Pai Patent & Trademark Law Firm; Chao-Chang David Pai

(57) ABSTRACT

A bottle cap includes a body and a security ring. The body has multiple breakable bridge portions located along the periphery of the body and connected to the security ring. Two non-breakable plates are connected between the body and the security ring. Each of the non-breakable plates includes multiple turning positions and multiple angles. When the multiple breakable bridge portions are broken, the non-breakable plates are still connected to the security ring. The non-breakable plates are extendable so that the body can be pulled away from the security ring for a distance.

8 Claims, 8 Drawing Sheets

BOTTLE CAP WITH NON-BREAK PLATES

BACKGROUND OF THE INVENTION

1. Fields of the Invention

The present invention relates to a bottle cap, and more particularly to a cap for sealing a bottle made of synthetic resin. The bottle cap includes non-breakable plates between the body of the cap and a security ring, and the non-breakable plates connect the cap with the security ring when the cap is removed from the bottle opening, and the security ring is mounted to the neck of the bottle.

2. Descriptions of Related Art

WO 2010/004919 discloses a container lid which includes a body, a security ring, and multiple breakable bridges connected between the body and the security ring. The body includes a skirt and threads formed on an inner side of the skirt. Multiple connection members are disposed at an inner periphery of the security ring. A protrusion extends from the lower edge of the skirt. Two non-breakable plates are located on two sides of the protrusion and are connected to the skirt and the security ring. The two non-breakable plates each include a first inclined portion and a second inclined portion, wherein the directions of inclination of the first and second inclined portions are opposite from each other. The first and second inclined portions are connected to each other via a middle portion. The directions of inclination of the two non-breakable plates are opposite from each other. The body is threadedly mounted to the threads of the bottle. The non-breakable plates connect the body to the security ring after the body is removed from the bottle opening. The security ring is retained on the neck of the bottle. The opened body is still connected to the bottle.

The shortcomings of the above mentioned container lid are that there is only one first inclined portion and one second inclined portion of each of the non-breakable plates. The angle between the first and second inclined portions is limited so that the distance that the body moves upward relative to the security ring is limited.

Besides, the non-breakable plates are not sufficiently supported so that when the body is mounted to the bottle opening, the non-breakable plates may be broken.

The present invention is intended to provide a bottle cap with non-breakable plates which are extendable to allow the bottle cap to be supported at a sufficient distance from the bottle so as to eliminate the abovementioned shortcomings.

SUMMARY OF THE INVENTION

The present invention relates to a bottle cap with non-breakable plates.

The bottle cap of the present invention is an integral cap which is mounted to a bottle opening having outer threads and a connection portion. The connection portion is located below the outer threads. The bottle cap comprises a body, a security ring, a rectangular opening between the body and the security ring, and two non-breakable plates disposed within the rectangular opening.

The body has a round top face and a cylindrical skirt that extends downward from the outer periphery of the top face. The skirt includes inner threads formed on the inner periphery thereof.

The security ring is connected to the lower edge of the skirt by multiple breakable first bridge portions. Multiple first tabs are located at the inner periphery of the security ring.

The rectangular opening is formed in an adjacent area between the skirt and the security ring. The rectangular opening includes a first opening defined in the lower edge of the skirt, and a second opening defined in the top edge of the security ring. A second tab extends from the middle portion of the first opening and is connected to the middle portion of the second opening by a breakable second bridge portion.

The two non-breakable plates are disposed within the rectangular opening with the second tab located between the two non-breakable plates.

The two non-breakable plates each include a top end and a bottom end. The top end is connected to the skirt and the bottom end is connected to the security ring. The width of the top connection portion between the top end of each non-breakable plate and the skirt is larger than the width of each non-breakable plate. The width of the bottom connection portion between the bottom end of each non-breakable plate and the security ring is larger than the width of each non-breakable plate.

Each of the non-breakable plates further includes a first inclined section and a second inclined section. In each of the two non-breakable plates, the first inclined section is formed with the top end and inclinedly extends downwardly and inclinedly along a circumferential direction of the skirt, and the second inclined section is formed with the first inclined section and extends downwardly and inclinedly along another circumferential direction of the skirt.

The top end of each non-breakable plate includes a first inclined side. A first angle is defined between the first inclined side and the first inclined section. A second angle is defined between the first inclined section and the second inclined section. The bottom end of each non-breakable plate includes a second inclined side. A third angle is defined between the second inclined side and the second inclined section.

Each non-breakable plate further includes a breakable first bridge and a breakable second bridge. The breakable first bridge is connected to the first inclined side and the first inclined section. The breakable second bridge is connected to the second inclined side and the second inclined section.

The advantages of the present invention are that:

Because the non-breakable plates have the abovementioned features, when the bottle cap is connected to the bottle opening, the non-breakable plates are not broken or deformed.

Because the width of the top connection portion and the width of the bottom connection portion are larger than the width of each non-breakable plate, the top end and the bottom end of each non-breakable plate are not broken. The body is always connected with the security ring except by excessive force, such as using scissors to cut the non-breakable plates.

When the bottle cap is opened the first time, the body is rotated and the torque breaks the breakable first bridge portions between the body and the security ring, the breakable second bridge portion of the second tab, and the first and second bridges.

Each of the non-breakable plates includes multiple turning positions and multiple angles. When the bottle cap is opened, the distance between the body and the security ring can be increased for convenience of dismounting the body from the bottle opening or re-capping of the body to the bottle opening.

The present invention will become more apparent from the following description when taken in conjunction with the accompanying drawings which show, for purposes of illustration only, a preferred embodiment in accordance with the present invention.

DETAILED DESCRIPTION OF THE PREFERRED EMBODIMENT

Figure 1:
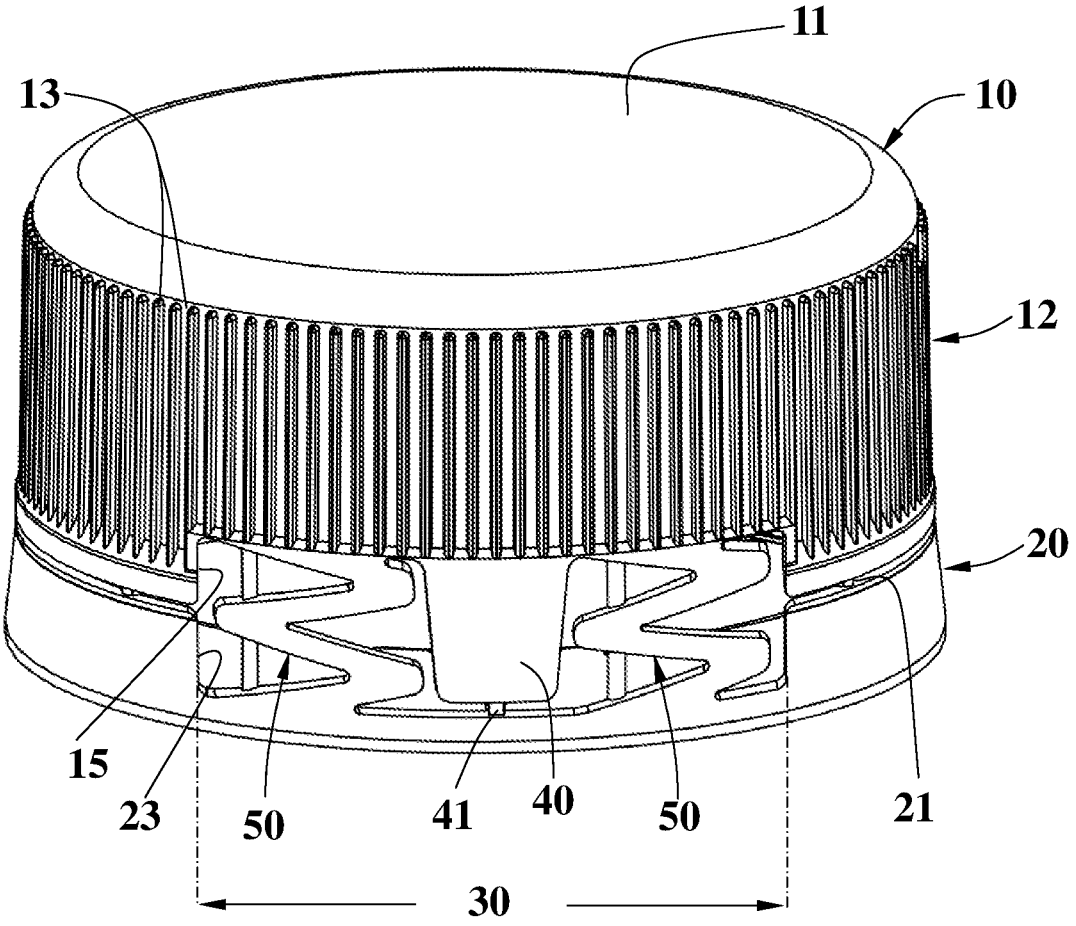
FIG. 1 is a rear perspective view of the bottle cap of the present invention.
Figure 2:
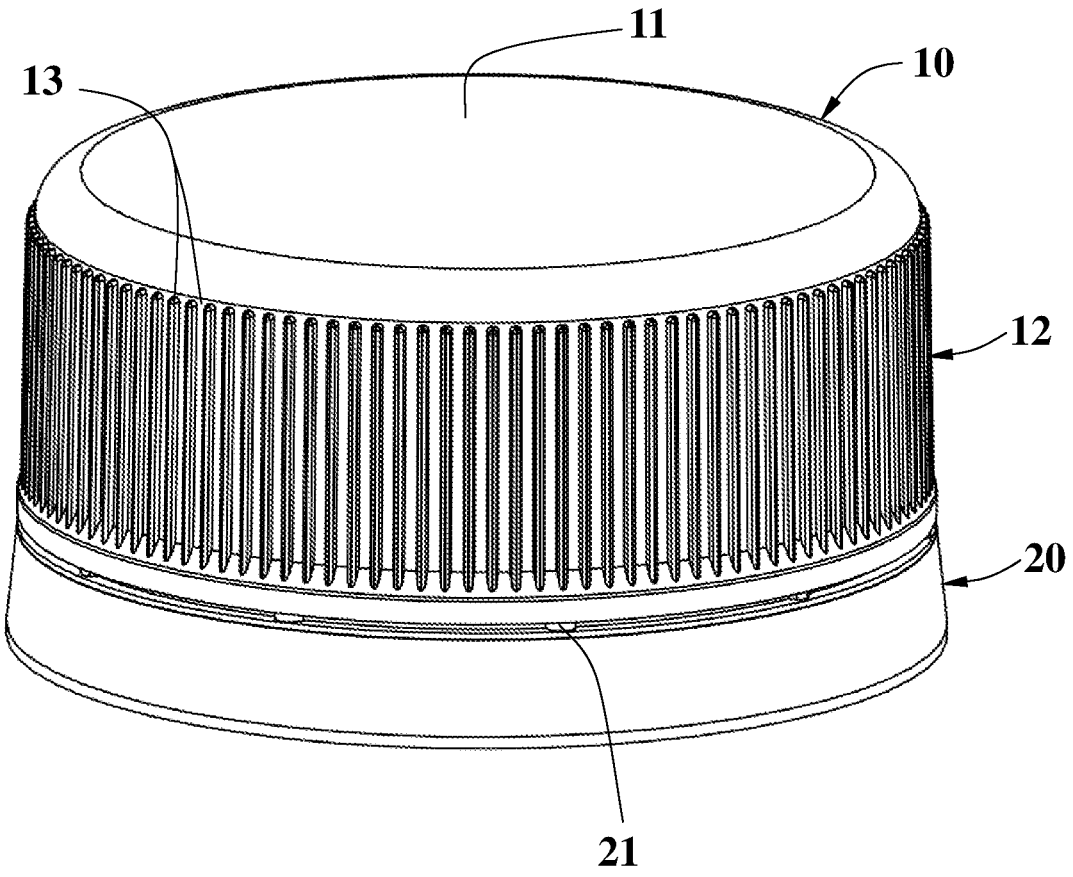
FIG. 2 is a front perspective view of the bottle cap of the present invention.

The bottle cap of the present invention is made of synthetic resin by injection molding or pressing. As shown in FIGS. 1-4, the bottle cap comprises a body 10 and a security ring 20. The body 10 includes a round top face 11 and a cylindrical skirt 12 extending downward from the outer periphery of the top face 11. The skirt 12 includes multiple ridges 13 formed on the outer periphery thereof for preventing users' fingers from slipping. The skirt 12 includes inner threads 14 formed on the inner periphery thereof. The security ring 20 is connected to the lower edge of the skirt 12 by multiple breakable first bridge portions 21. Multiple first tabs 22 are located at the inner periphery of the security ring 20. Each first tab 22 extends radially, inward and upward from the inner periphery of the security ring 20.

Figure 3:
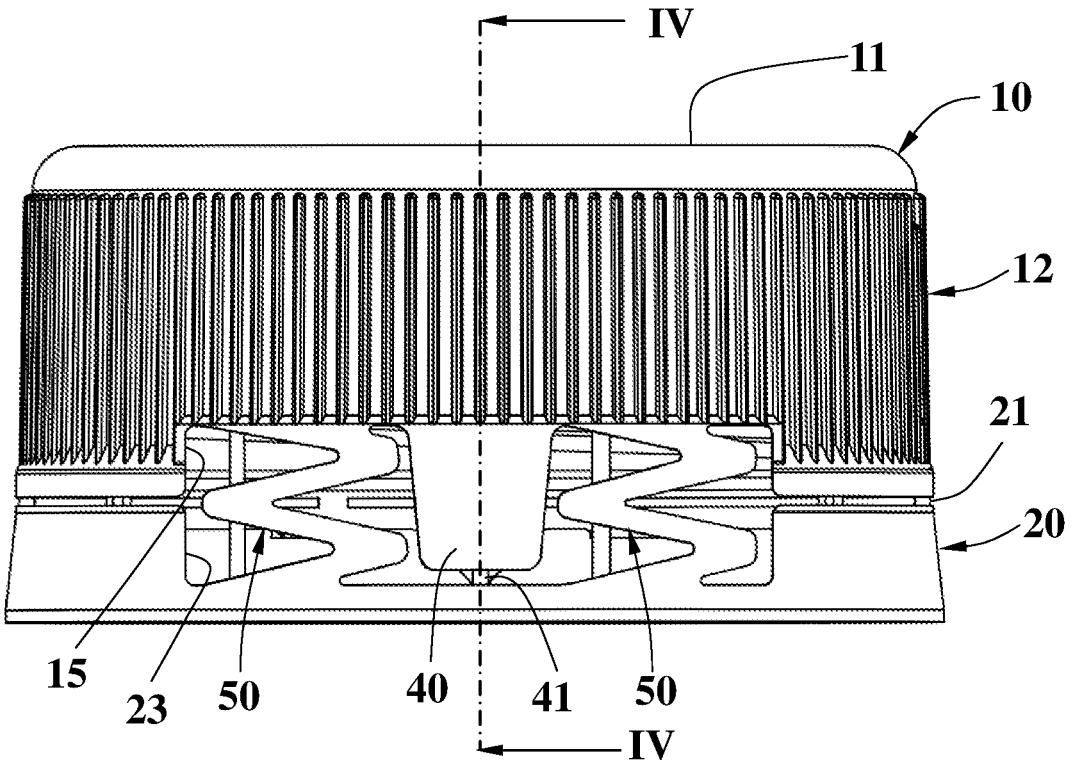
FIG. 3 is a rear side elevation view of the bottle cap of the present invention.
Figure 4:
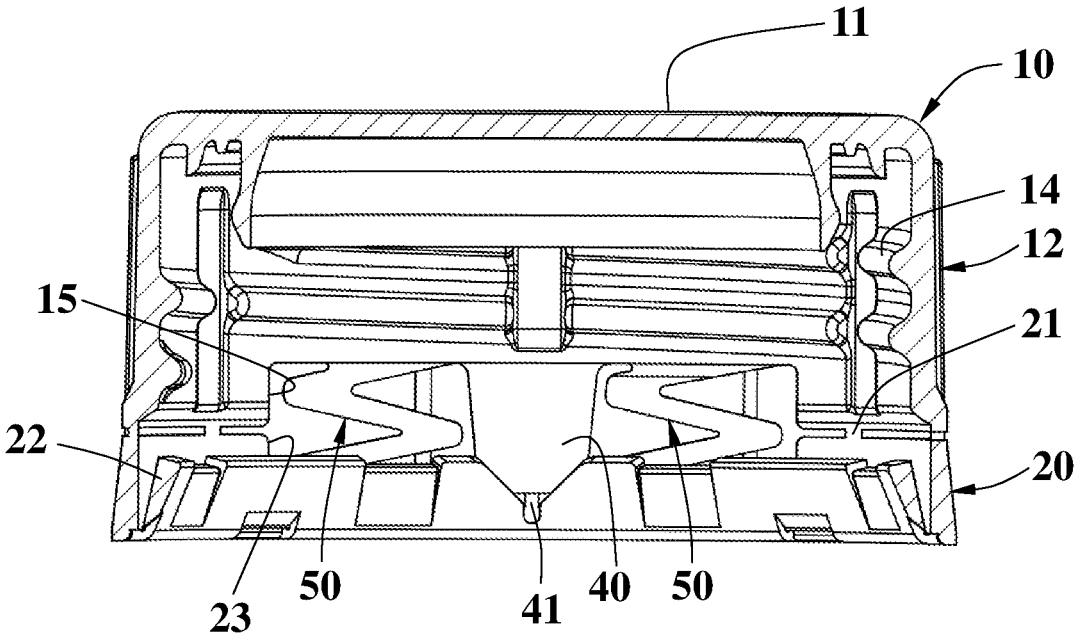
FIG. 4 is a cross sectional view, taken along line IV-IV in FIG. 3.

As shown in FIGS. 1 and 3, a rectangular opening is defined in an adjacent area 30 between the skirt 12 and the security ring 20. Specifically, the rectangular opening includes a first opening 15 defined in the lower edge of the skirt 12, and a second opening 23 defined in the top edge of the security ring 20. A second tab 40 extends from the middle portion of the first opening 15 and is connected to the middle portion of the second opening 23 by a breakable second bridge portion 41.

Figure 5:
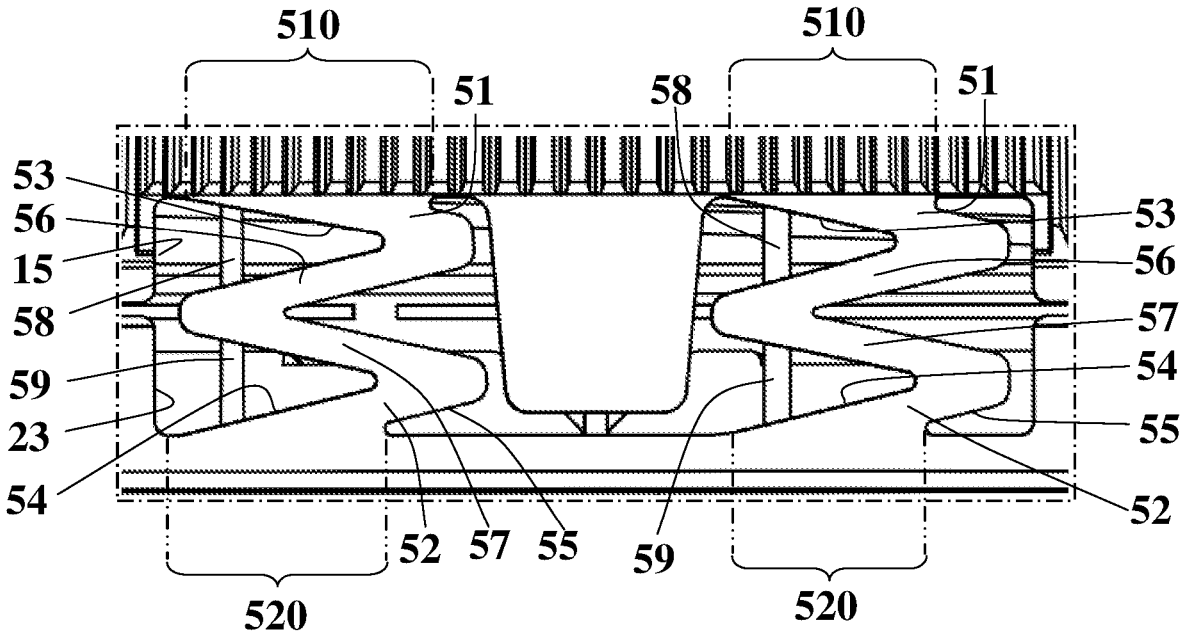
FIG. 5 shows the non-breakable plates of the bottle cap of the present invention.
Figure 6:
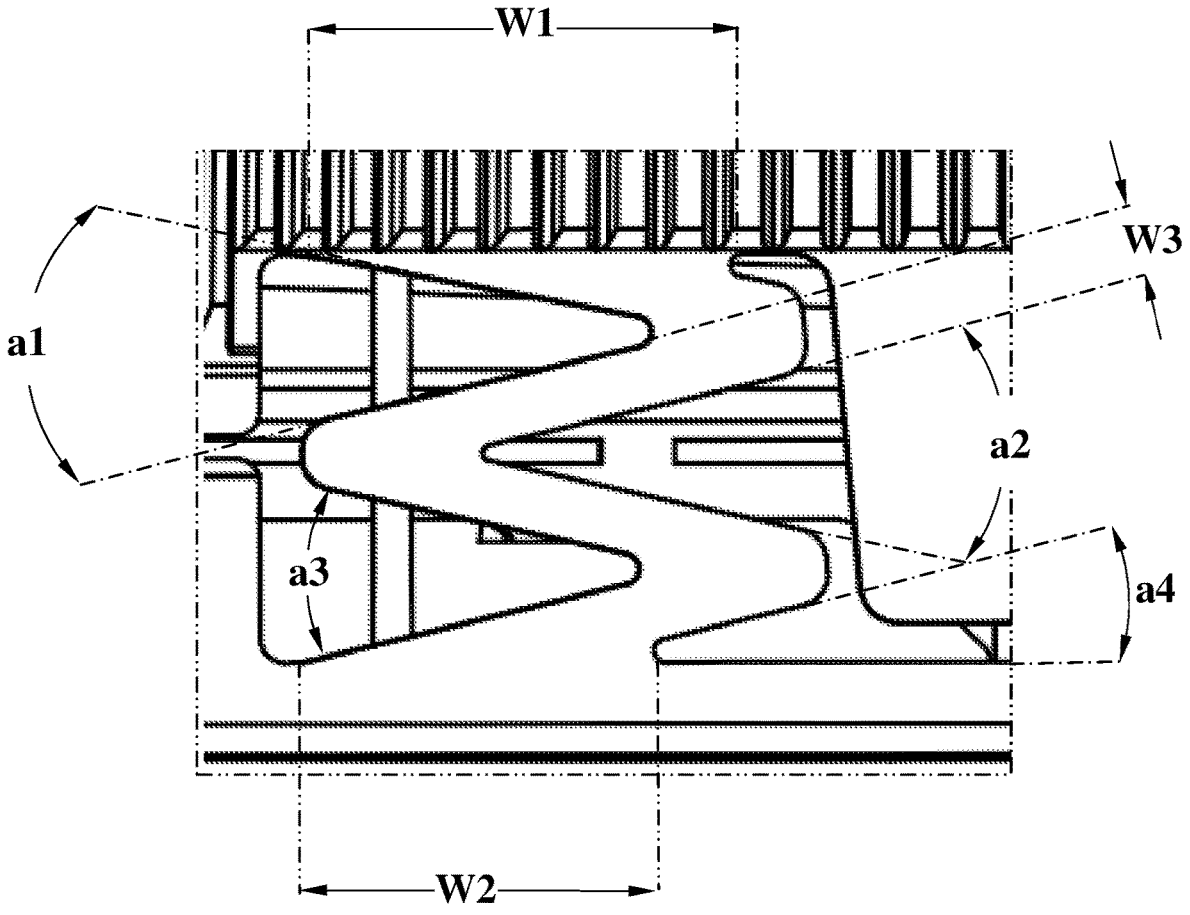
FIG. 6 is an enlarged view of the non-breakable plate of the bottle cap of the present invention.

As shown in FIGS. 3, 5, and 6, two non-breakable plates 50 of the same shape and direction are disposed within the rectangular opening with the second tab 40 located between the two non-breakable plates 50. Each non-breakable plate 50 includes a top end 51 and a bottom end 52. The top end 51 of each non-breakable plate 50 is formed with the skirt 12 by a top connection portion 510 between the top end 51 and the skirt 12, and the bottom end 52 of each non-breakable plate 50 is formed with the security ring 20 by a bottom connection portion 520 between the bottom end 52 and the security ring 20. The width W1 of the top connection portion 510 is larger than the width W3 of the elongate plate-like body of each non-breakable plate 50. The width W2 of the bottom connection portion 520 is larger than the width W3 of each non-breakable plate 50.

Each non-breakable plate 50 includes a first inclined section 56 and a second inclined section 57. The first inclined section 56 is formed with the top end 51 of each non-breakable plate 50 and extends downwardly and inclinedly along a circumferential direction of the skirt 12. The second inclined section 57 is formed with the first inclined section 56 and extends downwardly and inclinedly along another circumferential direction of the skirt 12. The top end 51 of each non-breakable plate 50 further includes a first inclined side 53. A first angle a1 is defined between the first inclined side 53 and the first inclined section 56. A second angle a2 is defined between the first inclined section 56 and the second inclined section 57. The bottom end 52 of each non-breakable plate 50 includes a second inclined side 54. A third angle a3 is defined between the second inclined side 54 and the second inclined section 57. The bottom end 52 of each non-breakable plate 50 includes a third inclined side 55. A fourth angle a4 is defined between the third inclined side 55 and the inner bottom of the second opening 23 of the rectangular opening of the security ring 20. The first angle a1 is substantially equal to the second angle a2 and the third angle a3. The fourth angle a4 is smaller than the third angle a3. Each of the first angle a1, the second angle a2 and the third angle a3 is less than 30 degrees.

Each non-breakable plate 50 includes a breakable first bridge 58 and a breakable second bridge 59. The breakable first bridge 58 is connected to and between the first inclined side 53 and the first inclined section 56. The breakable second bridge 59 is connected to and between the second inclined side 54 and the second inclined section 57.

Figure 8:
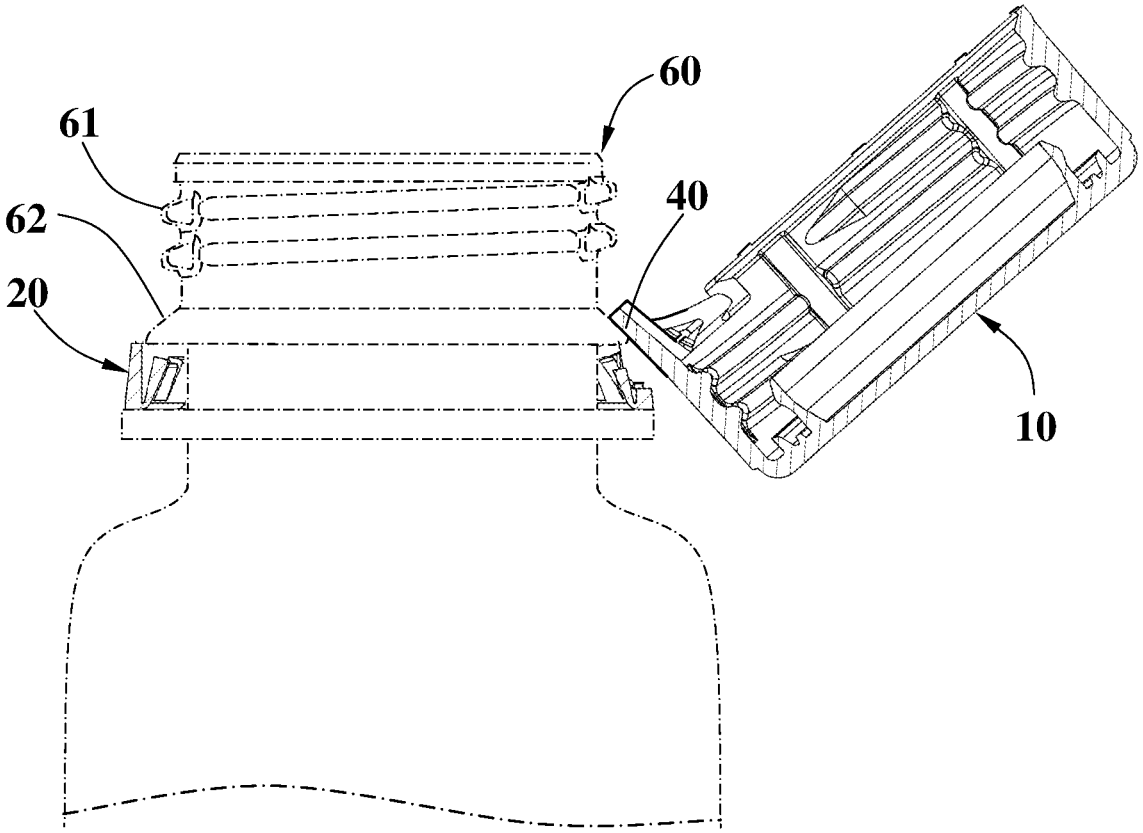
FIG. 8 shows that the bottle cap is temporarily positioned at the bottle opening after the bottle cap is removed from the closing position.

As shown in FIG. 8, there are outer threads 61 formed on the outside of a bottle opening 60, and a connection portion 62 which is located below the outer threads 61. The bottle cap of the present invention is mounted to the bottle opening 60. The bottle cap is threadedly connected to the outer threads 61 of the bottle opening 60 by the inner threads 14. The security ring 20 and the first tabs 22 of the bottle cap are located below the connection portion 62. The non-breakable plates 50 are not broken or deformed when the bottle cap is mounted to the bottle opening 60.

Figure 7:
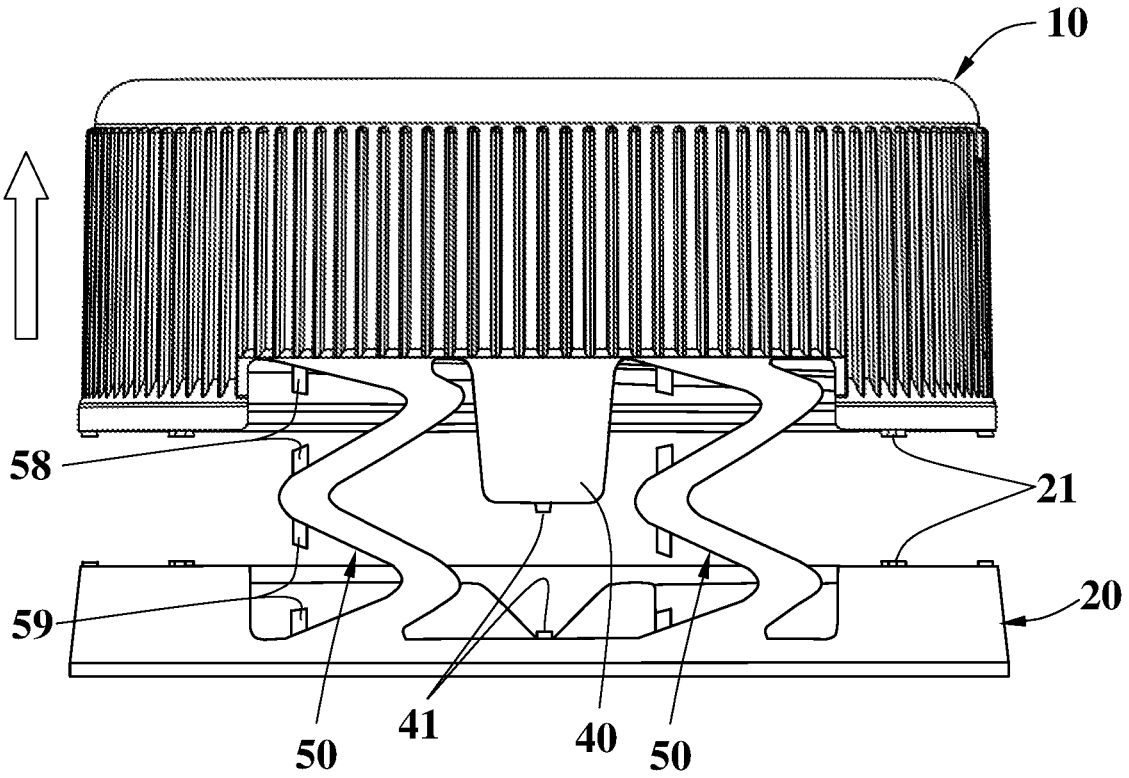
FIG. 7 shows that the non-breakable plates are extendable to increase the distance between the body and the security ring.

As shown in FIGS. 7 and 8, when the bottle cap is opened the first time, the body 10 and the security ring 20 are guided by the inner threads 14 and the outer threads 61 to move upward. The first tabs 22 of the security ring 20 contact the underside of the connection portion 62 so that a resistance is applied to the security ring 20. As the body 10 is rotated, a torque is applied along the rotational direction to break the breakable first bridge portions 21. These steps are well known in the art. For the present invention, when a resistance is applied to the security ring 20, the body 10 is rotated and applies a torque along the rotational direction to break the second bridge portion 41 of the second tab 40 and the first bridge 58 and the second bridge 59. The body 10 is further rotated and along with the release of the inner and outer threads 14, 61, the body 10 is rotatably moved upward, and the distance between the body 10 and the security ring 20 is increased. The inclination of the first inclined section 56, the second inclined section 57, the first inclined side 53, the second inclined side 54 and the third inclined side 55 of each of the two non-breakable plates 50 is increased. The first, second, third and fourth angles a1, a2, a3, a4 are increased thereby, until the inner threads 14 of the body 10 are completely separated from the outer threads 61 of the bottle opening 60, and the body 10 is removed from the bottle opening 60. During the rotational and upward movement of the body 10 when the second bridge portion 41 of the second tab 40 and the first bridge 58 and the second bridge 59 are broken, the first tabs 22 of the security ring 20 no longer compress the underside of the connection portion 62, and no resistance is applied to the security ring 20. However, the security ring 20 located below the connection portion 62 is rotated together with the body 10 due to the non-breakable plates 50. Accordingly, the non-breakable plates 50 are extended and are not twisted.

As shown in FIG. 8, after the body 10 is removed from the bottle opening 60, the body 10 is flipped and pivotably separated from the bottle opening 60 by using the non-breakable plates 50 as support, so that the users can enjoy the beverage in the bottle. The body 10 is retained at the position as shown in FIG. 8 with the outer periphery of the second tab 40 contacting on the top surface of the connection portion 62 of the bottle opening 60. The body 10 does not block the bottle opening 60. By flipping the body 10 toward the bottle opening 60, the second tab 40 is deformed and moved over the connection portion 62, the body 10 can re-cap the bottle opening 60. The body 10 is then rotated toward the closing direction by threadedly connect the inner threads 14 with the outer threads 61 of the bottle opening 60, so that the body 10 is able to close up the bottle opening 60.

In the above mentioned embodiment, the first inclined side 53 of each of the two non-breakable plates 50 is inclined in a same direction. It is noted that the first inclined sides 53 of the two non-breakable plates 50 may also be inclined in opposite directions.

While we have shown and described the embodiment in accordance with the present invention, it should be clear to those skilled in the art that further embodiments may be made without departing from the scope of the present invention.

What is claimed is:

1. A bottle cap for a bottle which includes a bottle opening with outer threads and a connection portion located below the outer threads, the bottle cap comprising:

a body having a round top face and a cylindrical skirt extending downward from an outer periphery of the top face, the skirt including inner threads formed on an inner periphery thereof;

a security ring connected to a lower edge of the skirt by multiple breakable first bridge portions, multiple first tabs located at an inner periphery of the security ring;

a rectangular opening defined in an adjacent area between the skirt and the security ring, the rectangular opening including a first opening defined in the lower edge of the skirt, and a second opening defined in a top edge of the security ring, wherein a second tab extends from a middle portion of the first opening and is connected to a middle portion of the second opening by a breakable second bridge portion; and two non-breakable plates disposed within the rectangular opening with the second tab located between the two non-breakable plates, each said non-breakable plate including a top end, a bottom end, a first inclined section, a second inclined section, a breakable first bridge and a breakable second bridge, wherein the top end is connected to the skirt by a top connection portion, the bottom end is connected to the security ring by a bottom connection portion, the top connection portion has a width larger than a width of the non-breakable plate, and the bottom connection portion has a width larger than the width of the non-breakable plate;

the first inclined section is formed with the top end of the non-breakable plate and extending downwardly and inclinedly along a circumferential direction of the skirt, the second inclined section is formed with the first inclined section and extending downwardly and inclinedly along another circumferential direction of the skirt;

the top end includes a first inclined side, a first angle defined between the first inclined side and the first inclined section, a second angle defined between the first inclined section and the second inclined section, the bottom end includes a second inclined side, a third angle defined between the second inclined side and the second inclined section, and the breakable first bridge is connected to and between the first inclined side and the first inclined section, the breakable second bridge is connected to and between the second inclined side and the second inclined section.

2. The bottle cap for a bottle as claimed in claim 1, wherein the bottom end of each said non-breakable plate includes a third inclined side, a fourth angle is defined between the third inclined side and an inner bottom of the second opening of the rectangular opening.

3. The bottle cap for a bottle as claimed in claim 1, wherein the first angle equals to the second angle and the third angle.

4. The bottle cap for a bottle as claimed in claim 3, wherein the angle of each of the first angle, the second angle and the third angle is less than 30 degrees.

5. The bottle cap for a bottle as claimed in claim 2, wherein the first angle equals to the second angle and the third angle, and the fourth angle is smaller than the third angle.

6. The bottle cap for a bottle as claimed in claim 5, wherein the angle of each of the first angle, the second angle and the third angle is less than 30 degrees.

7. The bottle cap for a bottle as claimed in claim 1, wherein the first inclined side of each of the two non-breakable plates is inclined in a same direction.

8. The bottle cap for a bottle as claimed in claim 1, wherein the first inclined sides of the two non-breakable plates are inlined in opposite directions.

* * * * *